United States Patent [19]

Russell et al.

[11] 4,251,789

[45] Feb. 17, 1981

[54] CIRCUIT BREAKER TRIP INDICATOR AND AUXILIARY SWITCH COMBINATION

[75] Inventors: Ronald R. Russell; Donald F. Aitken, Jr., both of Plainville, Conn.

[73] Assignee: General Electric Company, New York, N.Y.

[21] Appl. No.: 72,376

[22] Filed: Sep. 4, 1979

[51] Int. Cl.[3] ..... H01H 9/20; H01F 7/08

[52] U.S. Cl. ..... 335/174; 335/229

[58] Field of Search ..... 335/174, 229, 230, 234, 335/254, 170, 236, 179, 38, 164

[56] References Cited

U.S. PATENT DOCUMENTS

| | | | |
|---|---|---|---|
| 3,693,122 | 9/1972 | Willard | 335/174 |
| 3,755,766 | 8/1973 | Read, Jr. | 335/234 |
| 3,783,423 | 1/1974 | Mater et al. | 335/229 |
| 3,893,052 | 7/1975 | Kotos et al. | 335/229 |
| 3,944,957 | 3/1976 | Kotos et al. | 335/229 |
| 4,072,918 | 2/1978 | Read, Jr. | 335/174 |

*Primary Examiner*—Harold Broome

*Attorney, Agent, or Firm*—Robert A. Cahill; Walter C. Bernkopf; Philip L. Schlamp

[57] ABSTRACT

A plunger is normally held in a retracted, non-indicating position by a permanent magnet against the force of a spring biasing the plunger to an extended, indicating position protruding through an indicator cap. An electromagnet is selectively energized to develop flux in opposition to the magnet holding flux, whereupon the plunger pops to its indicating position. The cap internally mounts a pair of contacts which are bridged by a plunger mounted shorting ring incident with the plunger assuming its indicating position, thereby completing an external electrical indication circuit.

17 Claims, 3 Drawing Figures

CIRCUIT BREAKER TRIP INDICATOR AND AUXILIARY SWITCH COMBINATION

BACKGROUND OF THE INVENTION

The present invention relates to an electromagnetically operated indicating device having particular, but not limited application as trip indicators or targets for use in conjunction with a static trip circuit breaker to indicate the particular abnormal circuit condition, e.g., overload, short circuit, ground fault, responsible for tripping the breaker. Commonly assigned U.S. Pat. Nos. 4,068,283 and 4,004,201, are illustrative of this application. These fault indicators, for which commonly assigned U.S. Pat. No. 3,893,052 provides a representative disclosure, are mounted at the front of the circuit breaker and thus can provide a strictly local indication. Increasingly, users are requiring a remote indication that a circuit breaker has tripped. To satisfy this customer requirement, manufacturers have incorporated a so-called "bell alarm" switch in their circuit breakers. This switch, of the normally open type, is actuated to a closed condition incident with tripping of the circuit breaker, thereby completing an external signal circuit to provide a trip alarm or indication at a remote location. It will be appreciated that, in this arrangement, the trip alarm remotely indicates only that the circuit breaker has tripped, not why it tripped. This determination must be made by going to the tripped circuit breaker and observing which of its trip indicators has been actuated to its indicating condition.

It is accordingly an object of the present invention to provide an electromagnetically actuated indicator uniquely constructed to accommodate both a local and a remote indication.

An additional object is to provide an indicator of the above character which includes switch contacts for completing an external circuit to a remote signalling device incident with actuation of the indicator to its indicating condition.

A further object is to provide an indicator of the above character which is compact, inexpensive to manufacture and efficient in operation.

Other objects of the invention will in part be obvious and in part appear hereinafter.

SUMMARY OF THE INVENTION

In accordance with the present invention, there is provided an indicator having a plunger which is normally held in a retracted, non-indicating position against the bias of an internal spring by holding flux developed by a permanent magnet. An electromagnet is energized with a short pulse of electrical current to momentarily develop flux in opposition to the holding flux, whereupon the spring propels the plunger to an extended, indicating position with its outer end protruding beyond the indicator body through an opening in an indicator cap.

In accordance with a signal feature of the present invention, the indicator cap is constructed to mount diametrically opposed contacts of an auxiliary switch. At a location inwardly from its outer end, the plunger mounts a shorting ring in disengaged relation to the contacts while the plunger is in its retracted, non-indicating position. However, when the plunger pops to its indicating position, the shorting ring is carried into bridging electrical contacting engagement with the contacts, thereby closing the auxiliary switch. The contacts are led out to terminations external to the indicator body where electrical connections can be made to a signal circuit for energizing a remotely located signalling device.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings, in which.

Corresponding reference numerals refer to like parts throughout the several views of the drawings.

DETAILED DESCRIPTION

Figure 1:
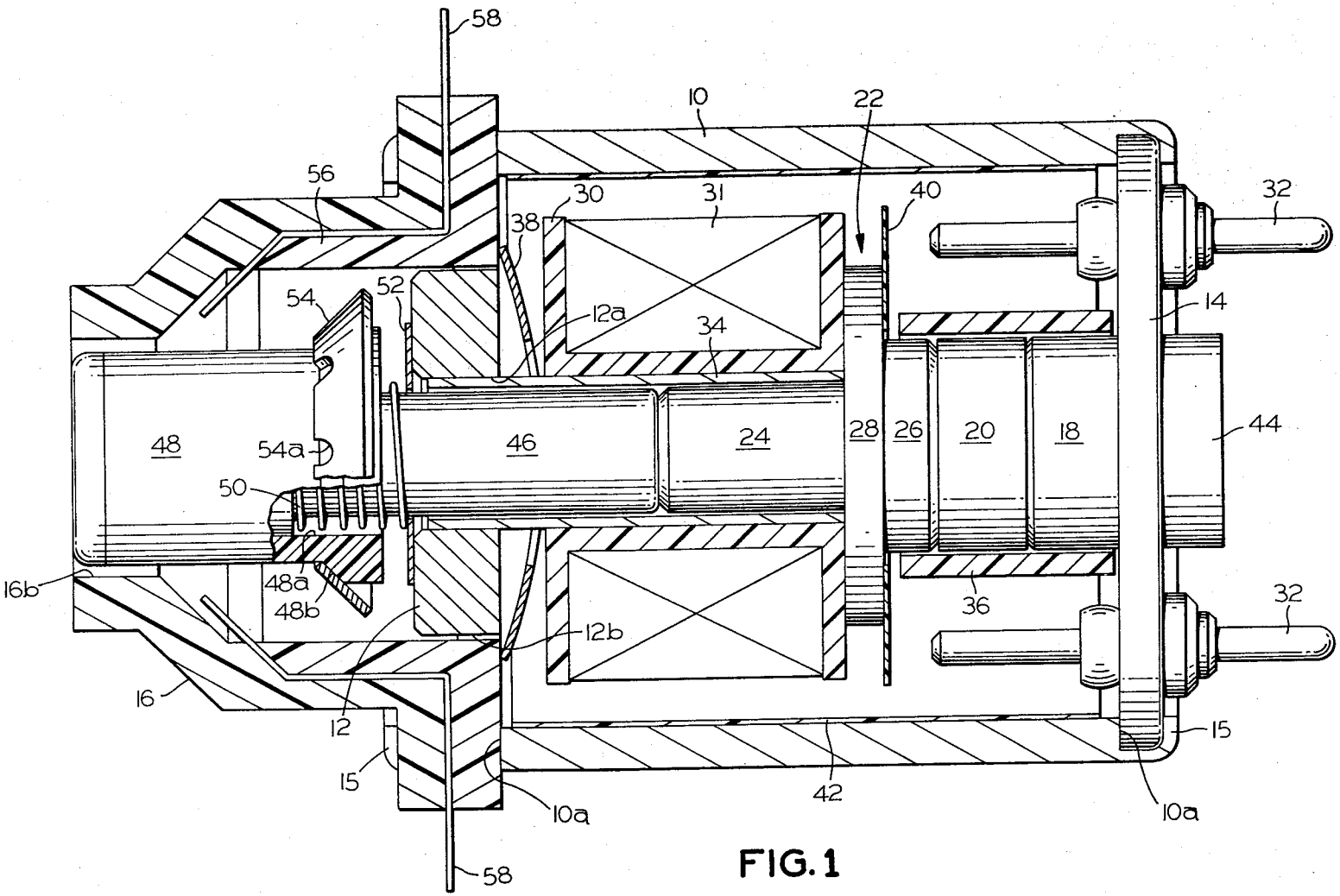
FIG. 1 is a longitudinal sectional view of a combination circuit breaker trip indicator and auxiliary switch constructed in accordance with the present invention.
Figure 2:
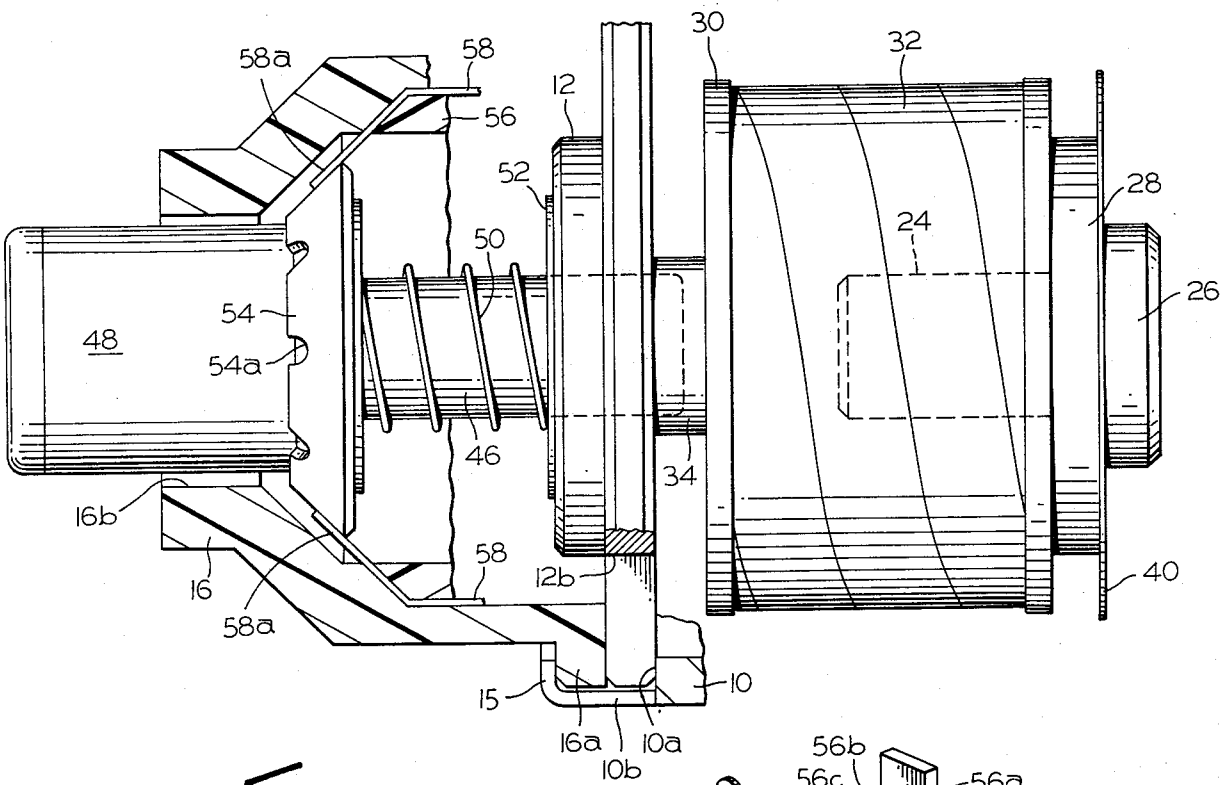
FIG. 2 is a fragmentary side view, partially in section, of the indicator-switch combination of FIG. 1 shown in its trip indicating-auxiliary switch closed condition.

The combination circuit breaker trip indicator and auxiliary switch of the present invention, seen in FIG. 1, includes a cylindrical housing 10 provided with internal annular shoulders **10*a* spaced inwardly from each end for seating front and rear end covers 12 and 14, respectively. The housing rear marginal end portion is crimped over, as indicated at 15, to secure the rear end cover in place. A molded plastic cap 16 of generally conical shape is seated against the outer surface of front cover 12 and is provided with an annular flange portion 16*a* (FIGS. 2 and 3) over which the housing front marginal end portion is crimped, as indicated at 15, pursuant to securing the front cover and cap to the housing. The housing and end covers are formed of a magnetically permeable material, such as iron or steel. Integrally formed on rear end cover 14 is an inwardly extending pole piece 18 positioned in abutment with one pole end of a permanent magnet 20** which is preferably formed of a cobalt-rare earth material, such as cobalt-samarium. Cobalt-rare earth magnets have a high coercive force and are very resistant to demagnetization. The particular properties of permanent magnets of this type are fully discussed in commonly assigned U.S. Pat. No. 3,671,893.

A flux diverter, generally indicated at 22, is formed of magnetically permeable material having opposed pole pieces 24 and 26 to each side of a flange 28 of larger diameter. Flux diverter pole piece 26 is positioned in abutment with the other pole end of permanent magnet 20, while its other pole piece 24 is embraced by a bobbin 30 of non-magnetic material on which is wound a coil 31 whose ends (not shown) are solder-connected to terminal pins 32 insulatively mounted in holes (not shown) formed in rear end cover 14. Disposed intermediate bobbin 30 and diverter pole piece 24 is a brass tube 34 having its one end inserted into a central opening **12*a* in front cover 12. An insulative sleeve 36 embraces rear end cover pole piece 18, permanent magnet 20 and diverter pole piece 26 to cooperate with brass tube 34 in preserving the concentric mounting of the various parts within housing 10. A spring washer 38 acting between front end cover 12 and bobbin 30 urges the internal parts to the right toward rear end cover 14 so as to insure intimate contact of pole pieces 18 and 26 with the opposed pole ends of permanent magnet 20. An insulative disc 40, adhered to diverter flange 28, and an insulative film 42, lining the inner surface of housing 10, cooperate with sleeve 36 in electrically isolating the inner ends of terminal pins 32 from all metal parts. Integrally formed with cover 14 is an external boss 44** which may be provided with a tapped bore (not shown) for accommodating a screw facilitating the mounting of the combination trip indicator-auxiliary switch of the present invention.

Freely, slidingly received within the left end of brass tube 34 is a plunger 46 formed of magnetically permeable material. A button 48, fully accommodatable within the hollow interior of cap 16 is provided with a central bore (not shown) into which the end of plunger 46 extending beyond front end cover 12 is press-fitted. Button 48 is centrally recessed, as indicated at **48*a* in FIG. 1 to accommodate a compression spring 50 confined between the button and front end cover 12. Preferably, a brass washer 52 is interposed between the right end of compression spring 50** and the front end cover.

The operation of the device thus far described is well understood in the art. Normally, coil 31 is de-energized, and, when plunger is manually reset to its position seen in FIG. 1 in abutment with diverter pole piece 24, it is held in this position against the bias of compression spring 50 by the magnetic force of permanent 20. Coil 31 is so wound and energized that its electromagnet flux produced at the interface of plunger 46 and diverter pole piece 24 is in opposition to the flux developed thereat by permanent magnet 20. When the force of spring 50 exceeds the istantaneous holding force resulting from the difference in the permanent magnet flux and the electromagnet flux, plunger 46 will be driven to the left as seen in FIG. 1, causing button 48 to be moved outwardly through a central opening **16*b* in cap 16 to a visibly protruding, trip indicating position seen in FIG. 2. The purpose of flux diverter flange 28 is to shunt to housing 10 some of the permanent magnet flux from the interface of the plunger 46 and pole piece 24 and some of the electromagnet flux from the interface of permanent magnet 20 and pole piece 26. This flux diverting action serves to afford greater latitude in the amplitude and duration of the current pulse energizing coil 31 requisite to achieving release of plunger 46. That is, diverting some of the permanent magnet flux from the interface of plunger 46 and pole piece 24 reduces the magnetic holding force which must be overcome by the electromagnet to effect plunger release, and thus the current pulse energizing coil 31 may be of a lower magnitude. On the other hand, diversion of electromagnet flux from the interface of permanent magnet 20 and pole piece 26 insures that the permanent magnet cannot be de-magnetized by excessive electromagnet flux, although this situation is not of particular concern when using the preferred cobalt-rare earth permanent magnet. It will be appreciated that overdriving coil 31** to the extent that the electromagnet flux overpowers both the permanent magnet hold force and the spring force must be avoided if release of the plunger is to be achieved.

Figure 3:
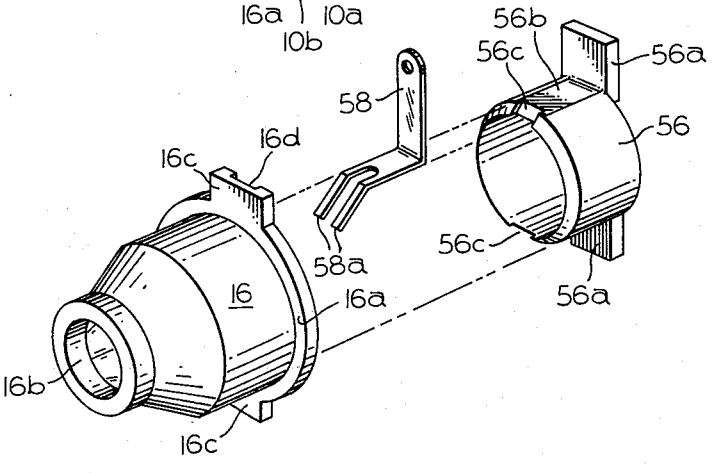
FIG. 3 is an exploded, assembly view of the cap portion of the indicator-switch combination of FIG. 1 to illustrate the mounting of the auxiliary switch stationary contacts.

To integrate the auxiliary switch function with the trip indicating function in the device of the present invention, an electrically conductive shorting ring 54 of generally conical configuration is press-fitted onto the body of button 48. The shorting ring is provided with a series of notches **54*a* so as to create, in effect, an annular array of barbs which accommodate insertion onto the button body back into engagement with a conforming annular shoulder 48*b* and thereafter maintain it in place. As seen in FIGS. 1 and 3, a sleeve 56 of insulative material is dimensioned to be nestingly received within cap 16. The cap is provided with opposed ears 16*c*, while insulative sleeve 56 is provided with corresponding, diametrically opposed ears 56*a*. With sleeve 56 nested within cap 16, their respective ears are in abutting relation as accommodated in diametrically opposed notches 12*b* in front end cover 12 and extend radially beyond the periphery of housing 10 through aligned notches 10*b* (FIG. 2) provided in the front marginal end portion thereof. It is seen that upon crimping of the housing, the nested relation of cap 16 and sleeve 56 is secured. In FIG. 3, it is seen that the cap ears 16*c* are undercut to provide radially extending grooves 16*d*, while insulative sleeve 56 is provided with diametrically opposed, longitudinal grooves 56*b* extending from ears 56*a* to notches 56*c* provided in the forward edge of the sleeve. These notches and grooves serve to accommodate an opposed pair of generally L-shaped conductive strips 58 seen in FIG. 1 to be captured between cap 16 and sleeve 46 in their nested relationship. The inner end of each strip is bifurcated to provide a pair of resilient stationary contact fingers 58*a* which extend angularly into the hollow interior of cap 16 where they stand poised for bridging engagement by ring 56 when plunger 46 springs to its extended position. The provision of the resilient, stationary contact fingers 58 insures low ohmic switch contacting engagement with shorting ring 54. The other ends of the strips 58 extend radially between ears 16*c*, 56*a*** to externally accessible terminations to which a remote signalling circuit is electrically connected.

From the foregoing description, it is seen that when coil 31 is energized to release plunger 46 which springs to its extended position to move button 48 to its trip indicating position in protruding relation with cap 16, conductive shorting ring 54 moves into electrical contacting engagement with the stationary contact finger **58*a* of conductive strips 58. Consequently, coincidentally with the achievement of a trip indicating function, an auxiliary switch constituted by shorting ring 54 and stationary contact fingers 58*a*** closes to complete an external circuit operative to provide a remote trip indication, such as by sounding an alarm or lighting a light. It is seen that the switch contacting engagement of the shorting ring with the stationary contacts also serves as a stop defining the extended position of the plunger. The additional auxiliary switch function is seen to be achieved by virtue of the present invention without adding to the physical size of the device and with minimal additional cost.

While the present invention has been described in the context of a combination trip indicator-auxiliary switch, it will be appreciated that the disclosed device may be sized up to accommodate a more powerful plunger spring, permanent magnet and electromagnet. Under these circumstances, the device could be utilized as a flux shifting trip coil wherein the plunger, in springing to its extended position, strikes a suitable latch pursuant to actually tripping a circuit breaker to its open circuit condition. The incidental closure of the auxiliary switch incorporated within the device completes an external bell alarm circuit to provide a remote indication that the circuit breaker has been tripped.

It will thus be seen that the objects set forth above, among those made apparent in the preceding description, are efficiently attained and, since certain changes may be made in the above construction without departing from the scope of the invention, it is intended that all matter contained in the description or shown in the accompanying drawings shall be interpreted as illustrative and not in a limiting sense.

Having described my invention, what I claim as new and desire to secure by Letters Patent is:

1. An electromagnetic device comprises, in combination:

A. a casing of magnetically permeable material;

B. a first end wall formed of magnetically permeable material and having a central opening therein;

C. a cap of insulating material secured with said first end wall in one end of said casing, said cap extending beyond said first end wall and having a central opening in registry with the opening in said first end wall;

D. a second end wall of magnetically permeable material secured in the other end of said casing;

E. a plunger of magnetically permeable material slidingly received in said opening in said first end wall for reciprocating movement between a retracted position and an extended position with one end thereof protruding through and outwardly beyond said opening in said cap;

F. a spring biasing said plunger to its extended position;

G. a permanent magnet positioned within said casing intermediate the other end of said plunger and said second end wall, said magnet developing holding flux to retain said plunger in its retracted position against the bias of said spring;

H. an electromagnetic coil energizeable by a pulse of current to develop flux in opposition to said holding flux, thereby empowering said spring to propel said plunger to its extended position;

I. a pair of contacts mounted within said cap in electrically isolated relation, each said contact electrically connected with a separate conductive lead-in strip having an electrical termination external to said casing facilitating connection with an external signalling circuit; and J. a conductive shorting member carried by said plunger for movement into bridging electrical contacting engagement with said contact pair when said plunger assumes its extended position.

2. The electromagnetic device defined in claim 1, which further includes a button affixed to said one end of said plunger and fully accommodated within the interior of said cap while said plunger is in its retracted position, with said plunger in its extended position, said button protruding through said cap central opening beyond said cap to provide a visual indication of pulsed current energization of said coil.

3. The electromagnetic device defined in claim 2, wherein said shorting member is in the form of a conductive ring carried by said button.

4. The electromagnetic device defined in claim 2, wherein said spring is a compression spring acting between said button and said first end wall.

5. The electromagnetic device defined in claim 1, which further includes an insulative sleeve secured in nested relation within said cap in said one end of said casing, said contact lead-in strips being securely captured between said cap and said sleeve.

6. The electromagnetic device defined in claim 5, wherein each said contact is integrally formed with its associated leading strip at one end thereof, said one strip end being bifurcated to provide a pair of free-standing resilient contact fingers individually engageable with said shorting member.

7. The electromagnetic device defined in claim 5, wherein said cap and said sleeve are integrally formed with corresponding, laterally extending ears projecting through notches in said casing, said lead-in strips being additionally captured between corresponding cap and sleeve ears as they extend to their terminations externally of said casing.

8. The electromagnetic device defined in claim 7, wherein each said contact is integrally formed with its associated lead-in strip at one end thereof, said one strip end being bifurcated to provide a pair of free-standing resilient contact fingers individually engageably with said shorting member.

9. The electromagnetic device defined in claim 8, which further includes a button affixed to said one end of said plunger and fully accommodated within the interior of said cap while said plunger is in its retracted position, with said plunger in its extended position, said button protruding through said cap central opening beyond said cap to provide a visual indication of pulsed current energization of said coil.

10. The electromagnetic device defined in claim 9, wherein said shorting member is in the form of a conductive ring carried by said button.

11. The electromagneticdevice defined in claim 10, wherein said spring is a compression spring acting between said button and said first end wall.

12. The electromagnetic device defined in claim 1, which further includes a flux diverter having a first pole piece in abutment with one pole end of said permanent magnet, a second pole piece positioned to be abutted by said other end of said plunger in its retracted position, and an intermediate flange terminating in close proximity with said casing.

13. The electromagnetic device defined in claim 1, wherein each said contact is carried by the inner end of its electrically associated lead-in strip, said device further including an insulative sleeve secured in nested relation within said cap in said one end of said casing, said lead-in strips being securely captured between said nested cap and sleeve.

14. The electromagnetic device defined in claim 13, wherein said cap and said sleeve are integrally formed with corresponding, laterally extending ears projecting through notches in said casing, said lead-in strips being additionally captured between corresponding cap and sleeve ears as they extend to their terminations externally of said casing.

15. The electromagnetic device defined in claim 14, which further includes a button affixed to said one end of said plunger and fully accommodated within the interior of said cap while said plunger is in its retracted position, with said plunger in its extended position, said button protruding through said cap central opening beyond said cap to provide a visual indication of pulsed current energization of said coil.

16. The electromagnetic device defined in claim 15, wherein said shorting member is in the form of a conductive ring carried by said button.

17. The electromagnetic device defined in claim 16, wherein said spring is a compression spring acting between said button and said first end wall.

* * * * *